US008641312B2

(12) United States Patent
Todd, IV et al.

(10) Patent No.: US 8,641,312 B2
(45) Date of Patent: Feb. 4, 2014

(54) ROTATING SPIGOT FOR TRUSSES

(75) Inventors: Harry William Todd, IV, Midland, TX (US); Bradley Wayne Barnhill, Midland, TX (US)

(73) Assignee: Tomcat USA, Inc., Midland, TX (US)

( * ) Notice: Subject to any disclaimer, the term of this patent is extended or adjusted under 35 U.S.C. 154(b) by 706 days.

(21) Appl. No.: 12/823,871

(22) Filed: Jun. 25, 2010

(65) Prior Publication Data

US 2011/0023406 A1 Feb. 3, 2011

Related U.S. Application Data

(60) Provisional application No. 61/230,461, filed on Jul. 31, 2009.

(51) Int. Cl.
*F16D 3/00* (2006.01)

(52) U.S. Cl.
USPC ..... 403/78; 403/165

(58) Field of Classification Search
USPC ..... 403/78, 164, 165, 371; 62/655.1; 294/1.1, 82.1, 89
See application file for complete search history.

(56) References Cited

U.S. PATENT DOCUMENTS

| | | | | | |
|---|---|---|---|---|---|
| 3,707,304 | A * | 12/1972 | Gostling | 403/293 |
| 3,877,735 | A * | 4/1975 | Demler, Sr. | 285/382.1 |
| 3,908,261 | A * | 9/1975 | Demler, Sr. | 29/450 |
| 5,131,572 | A * | 7/1992 | Spengler | 222/545 |
| 5,711,131 | A * | 1/1998 | Thomas | 52/656.9 |
| 6,675,546 | B2 * | 1/2004 | Coles | 52/655.1 |
| 7,197,856 | B2 * | 4/2007 | Coles | 52/638 |
| 8,099,913 | B1 * | 1/2012 | Dodd | 52/143 |
| 2011/0023406 | A1 * | 2/2011 | Todd et al. | 52/655.1 |
| 2011/0265421 | A1 * | 11/2011 | Kempf et al. | 52/741.1 |

* cited by examiner

*Primary Examiner* — Victor MacArthur
(74) *Attorney, Agent, or Firm* — Slater & Matsil, L.L.P.

(57) ABSTRACT

A rotating connector that is particularly suitable for staging and lighting trusses and that includes a rotating connector and an inside sleeve having at least two portions. The combination of the rotating connector and the sleeve are held together by an outside sleeve, and the assembled sleeve is attached to a truss member.

14 Claims, 4 Drawing Sheets

ROTATING SPIGOT FOR TRUSSES

This application claims the benefit of U.S. Provisional Patent Application Ser. No. 61/230,461, filed on Jul. 31, 2009, and entitled "Rotating Spigot For Trusses," which application is incorporated herein by reference.

TECHNICAL FIELD

This invention relates generally to the field of staging and lighting platform trusses and support systems, and more particularly to a unique pivoting spigot or connector assembly for ease of assembly and disassembly of temporary platforms and staging used for performances and special events.

BACKGROUND

Although temporary staging and lighting trusses and platforms have been used throughout the world for several decades, such trusses and platforms that are required to have an unusual shape or features often present challenges. These special event Stages or platforms may require many different components, one of a kind components, or on-site modifications of existing components that may challenge the integrity of the platform. The present invention alleviates many of the disadvantages of assembling a special event stage by providing a rotating spigot or truss connector assembly that is robust and allows great flexibility during assembly of a staging platform, and at the same time does not comprise the integrity of the staging platform.

SUMMARY OF THE INVENTION

According to a preferred embodiment, the present invention is a spigot or connector assembly for use with trusses. The connector assembly comprises a rotating member having a connector, a base portion with a first maximum outside dimension and a neck portion connecting the base portion and the connector. The outside dimension of the neck portion has a second maximum outside dimension that is less than the first maximum outside dimension of the base portion. The connector portion typically will be a clevis or a spade member such that a first truss member having a connector with a rotating clevis can be attached to a second truss member having a matching spade member that may or may not rotate. Both the clevis member and the spade member define an aperture so that when the spade member is inserted into the clevis member a pin can be inserted into the apertures of the clevis and spade members to firmly secure the two truss members together. Further, in a preferred embodiment, the base portion and the neck portion are cylindrical shaped as are the first and second recesses. However, it will be appreciated that other shapes for the base portion, the neck portion, and the first and second recesses (as discussed below) may be used, so long as one of the portions or recesses have a round cross section. As an example only, one or both of the base portion and the neck portion could be hexagon, octagonal or other shape, or have slots to allow for a generous supply of a lubricant. Likewise, it is also possible that the base portion and/or the neck portion have a round cross section and one or both of the recesses could define an octagon or other shape.

The connector assembly further includes a plurality of sleeve assembly members (preferably two) that fit together to form an inside sleeve for receiving the rotating member. The inside sleeve defines a first recess for receiving the base portion, that has a minimum dimension that is greater than said first maximum dimension of the base portion. A second recess receives the neck portion and has a minimum dimension that is greater than the second maximum dimension of the neck portion. The inside sleeve also, of course has an outside dimension.

An outside sleeve has an inside dimension that is the same as the outside dimension of the assembled inside sleeve and is placed over the inside sleeve. The fully assembled spigot or connector assembly will typically be inserted into an end of a truss member. Alternately, if the minimum dimension is equal to or greater than the outside diameter of the truss member, the connector assembly may be placed over the end of the truss member.

In a preferred embodiment the sleeve assembly members also include a collar portion that fit together to form a collar at an end of the assembled inside sleeve that is at nearest the neck recess. The collar will have an outside dimension that is greater than the outside dimension of the outside sleeve. Also to avoid excess ware and facilitate assembly, the sleeve assembly members may define a chamfer between the first recess and the second recess.

The foregoing has broadly outlined the features of the present invention in order that the detailed description of the invention that follows may be better understood. Additional features and advantages will be described hereinafter, which form the subject of the claims of the invention. It should be appreciated by those skilled in the art that the conception and specific embodiments disclosed might be readily used as a basis for modifying or designing other structures or processes for carrying out the same purpose as the present invention. It should also be realized by those skilled in the art that such constructions do not depart from the spirit or scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1A:
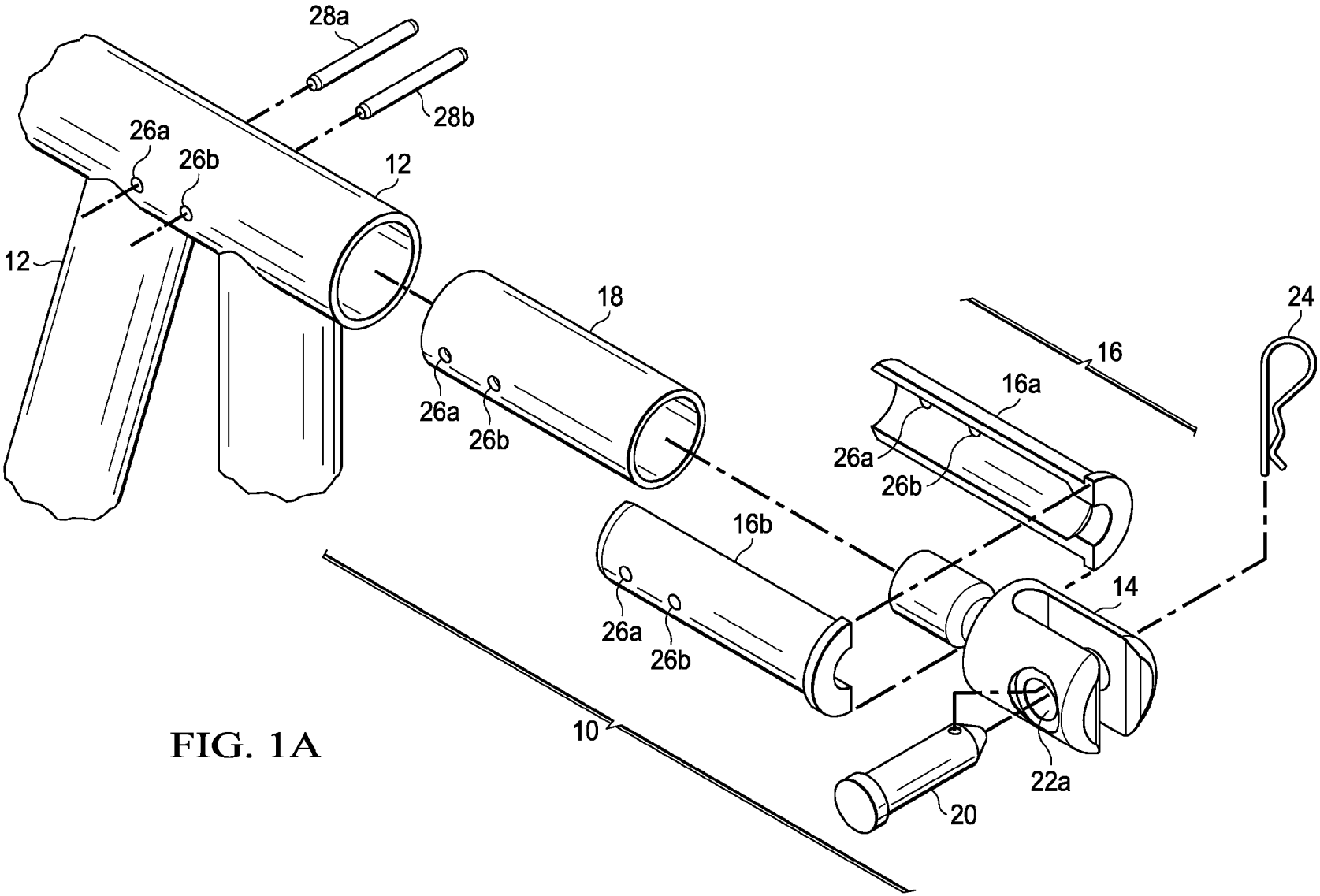
FIG. 1A is a perspective exploded view and FIG. 1B is an assembled view of the connector assembly of the invention installed on a staging truss.
Figure 1B:
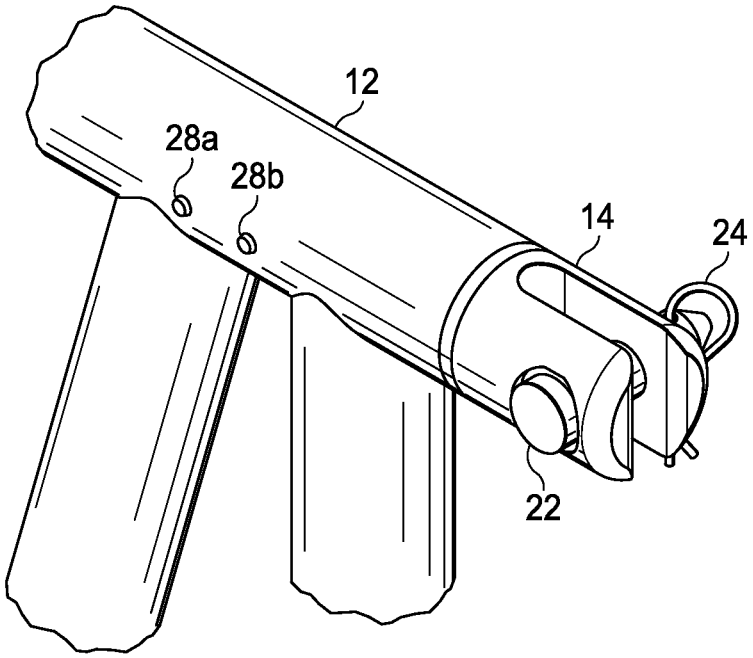

Referring now to FIG. 1A, there is shown an exploded perspective view of the spigot or connector assembly 10 of the present invention and the end view of a staging or lighting truss 12 that will be incorporated with the connector assembly 10. FIG. 1B is a perspective view of the assembled connector assembly 10 of the present invention securely attached to the truss. As shown, the connector assembly 10 of this embodiment comprises a rotating connector 14 that is a clevis, an inside sleeve 16 comprised of two halves 16*a* and 16*b*, and an outside sleeve 18. It is important to understand that although the rotating connector 14 is illustrated in FIG. 1A as a clevis connector, the rotating connector may also comprise other shapes, such as for example, a spade connector that can be inserted between the two arms of the clevis. FIG. 1A further illustrates how a pin 20 may be inserted through apertures 22*a* and 22*b* (aperture 22*b* is not visible in FIGS. 1A and 1B) and secured with a cotter pin 24. In the embodiment illustrated, the spigot connector assembly 10 is inserted into the end of truss 12 and the completely assembled structure also includes apertures 26*a* and 26*b* that extend through the inside sleeve assembly 16, the outside sleeve 18 and the truss 12. The assembled connector 10 is then inserted into (preferably with a force fit) the end of a truss member and secured to the truss 12 by driving force fit pins 28*a* and 28*b* into the apertures.

Figure 2A:
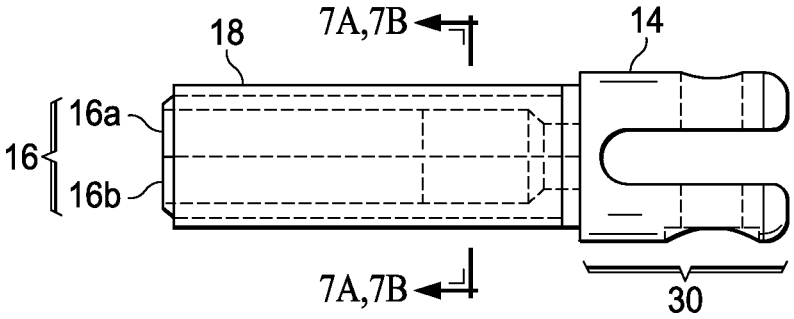
FIG. 2A is a side view of the connector assembly of the present invention wherein the connector is a clevis.
Figure 2B:
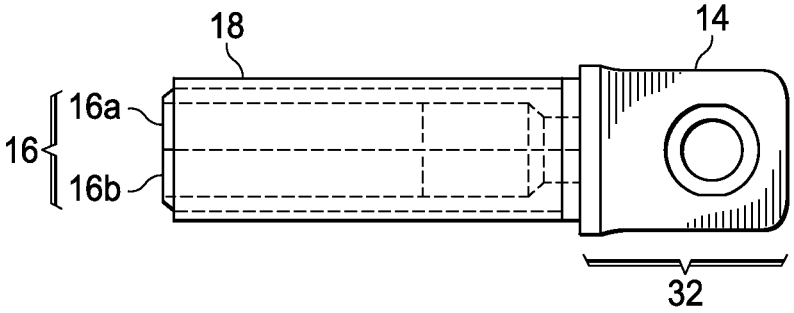
FIG. 2B is a side view of the assembly wherein the connector is a spade that can be inserted between the two arms of the clevis.

FIGS. 2*a* illustrates the spigot or assembled connector assembly 10 with a clevis 30 for the rotating connector 14, and FIG. 2*b* illustrates the connector assembly 10 with a spade 32 as the rotating connector 14.

Figure 3:
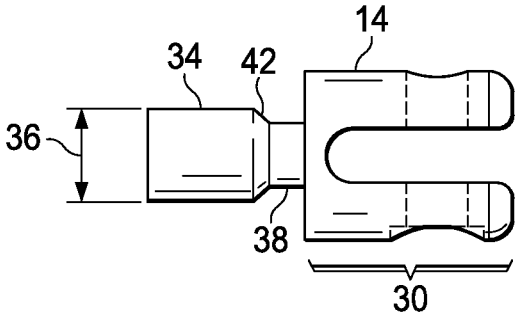
FIG. 3 illustrates the rotating member of the present invention with a clevis as the connector.
Figure 4:
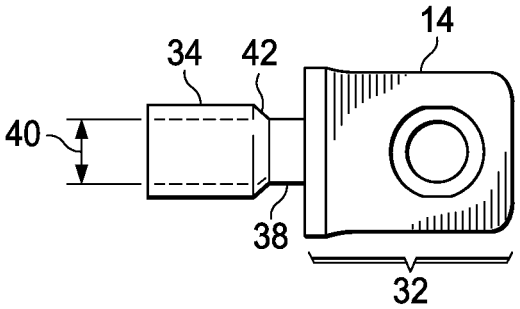
FIG. 4 illustrates the rotating member of the present invention with a spade as the connector.

Referring now to FIGS. 3, there is shown a side view of the rotating connector 14 formed with a clevis member 30. FIG. 4 shows the rotating connector 14 formed with a spade member 32 instead of a clevis member 30, but is otherwise the same. As shown, the rotating member 14 includes the connector portion, which may be either a clevis 30, a spade 32 or another shape. Also included is a base portion 34 having an outside diameter 36, and a neck portion 38 having an outside diameter 40 that connects base portion 34 with the connector, such as a clevis 30 or a spade). It is noted that the diameter 36 of the base portion 34 is greater than the diameter 40 of the neck portion 38, and that the transition area 42 between the base portion 34 and the neck portion 38 may include a chamfer.

Figure 5A:
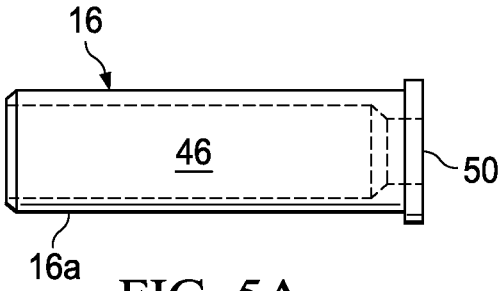
FIGS. 5A and 5B show a side view an embodiment of the present invention wherein the inside sleeve comprises two assembled halves.
Figure 6A:
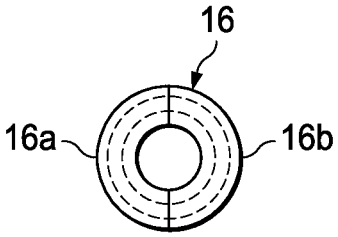
FIG. 6A illustrate an end view of the two assembled halves of FIGS. 5A and 5B, and FIG. 6B illustrate an embodiment wherein three sleeve assembly members are used to form the assembled inside sleeve.
Figure 5B:
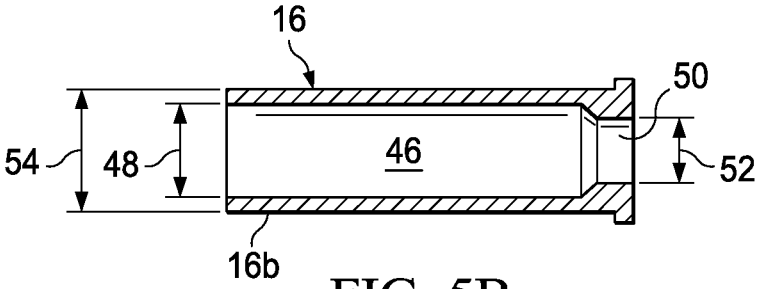
Figure 6B:
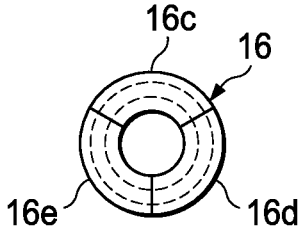

In the embodiment shown in FIGS. 5A and 5*b*, the inside sleeve 16 comprises two members 16*a* and 16*b* that fit together to form the inside sleeve 16. FIG. 6A illustrates an end view of the two sleeve members that have been placed together. The bold line represents surfaces of the two portions 16*a* and 16*b* that fit together. As shown, the assembled inside sleeve defines a first cylindrically shaped recess 46 for receiving the base portion 34 of the rotating connector 14 and recess 40 has a diameter 48 that is greater than the diameter 36 of the base portion 34 of the rotating connector 14. A second cylindrically shaped recess 50 for receiving the neck portion 38 has a diameter 52 that is less than the diameter 38 of the recess 46, but is greater than the diameter 40 of the neck portion 38 of the rotating connector 14. Each of the two inside sleeve members also include a portion of a collar 52. FIGS. 5*a* and 5*b* also show the outside diameter 54 of the inside sleeve 16. FIG. 6A illustrates an end view wherein the inside sleeve 16 comprises two sleeve assembly members and FIG. 6B illustrates three sleeve assembly members 16*c*, 16*d* and 16*e*.

Figure 7A:
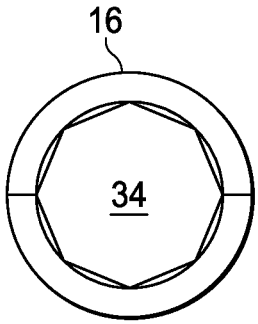
FIGS. 7A and 7B illustrate the use of a base portion and cooperating recess that receives the base portion having differently shaped cross sections.
Figure 7B:
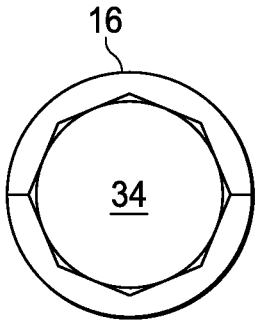
Figure 8A:
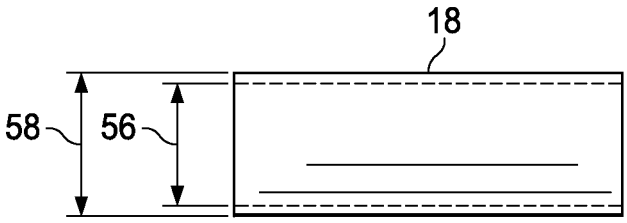
FIGS. 8A and 8B are a side and end view of the outside sleeve.
Figure 8B:
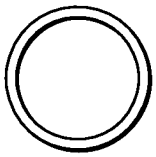

FIGS. 7A and 7B illustrate two different embodiments of a cross section of FIG. 2A along view line 7A, 7B-7A, 7B wherein the base portion 34 of the rotating connector 14 and the recess 46 of the sleeve assembled inside 16 have differently shaped cross sections. As shown in FIG. 7A the cross section of the base portion 34 is octagonal shaped rather than cylindrical shaped. In FIG. 7B, the recess is octagonal shaped. The cross sections shown in FIGS. 7A and 7B could also be used with the neck portion 38 and recess 50. It is important however, that at least one of the base portion 34 cross section or recess 46 be cylindrical shaped.

To complete the assembly of the connector of this embodiment of the invention, the sleeve assembly members, such as 16*a* and 16*b*, are placed around the rotating connector 14 and then the combination of the sleeve assembly members and the rotating connector are placed within an outside sleeve 18. Outside sleeve 18 preferably has an inside diameter 56 that is the same as the diameter 54 of the outside sleeve 16, and therefore is a force fit. The outside diameter 58 is also the same as the inside diameter of a tubular truss member so that it also requires a force fit.

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, devices or circuitry described in the specification. As one of ordinary skill in the art will readily appreciate from the disclosure of the present invention, devices presently existing or later to be developed, that perform substantially the same function or achieve substantially the same result as the corresponding embodiments described herein may be utilized according to the present invention. Accordingly, the appended claims are intended to include within their scope such embodiments and devices.

What is claimed is:

1. A connector assembly connecting a first truss to a second truss, said connector assembly comprising:

a rotating member comprising a connector, a base portion having a first maximum outside dimension and a neck portion connecting said base portion and said connector, said neck portion having a second maximum outside dimension that is less than said first maximum outside dimension;

at least two sleeve assembly members that fit together to form an inside sleeve retaining said rotating member, said inside sleeve defining a first recess receiving said base portion that has a minimum dimension that is greater than said first maximum outside dimension, and a second recess receiving said neck portion having a minimum dimension that is greater than said second maximum outside dimension, and said inside sleeve having an outside dimension, and each of said at least two sleeve assembly members comprising a collar portion said two sleeve members comprising said collar portion fitting together to form a collar at an end of said sleeve proximate said neck portion, said collar having an outside dimension that is greater than said outside dimension of said outside sleeve; and an outside sleeve receiving said inside sleeve, said outside sleeve having an outside dimension, and an inside dimension that is the same as said outside dimension of said inside sleeve, and wherein one of said first and second trusses receives said outside sleeve of said connector assembly.

2. The connector assembly of claim 1 wherein said at least two sleeve members comprise more than two members.

3. The connector assembly of claim 1 wherein said base member and said first recess have a round cross-section.

4. The connector assembly of claim 3 wherein both said neck portion and said second recess have a round cross-section.

5. The connector assembly of claim 1 wherein said neck portion and said second recess have a round cross-section.

6. The connector assembly of claim 1 wherein said connector is selected as one of a clevis and a spade, and wherein said one of a clevis and a spade defining an aperture there-through for receiving a pin.

7. The connector assembly of claim 1 wherein at least one of said base portion and said first recess has a round cross-section, and wherein at least one of said neck portion and said second recess has a round cross section.

8. A connector assembly connecting a first truss to a second truss, said connector assembly comprising:

a rotating member having a connector, a cylindrical shaped base portion with a first outside diameter, and a cylindrical neck portion connecting said base portion and said connector, said neck portion having a second outside diameter that is less than said first outside diameter of said base portion;

at least two sleeve assembly members that fit together to form an inside sleeve retaining said rotating member, said inside sleeve defining a first cylindrical recess receiving said base portion, said first cylindrical recess having a diameter that is greater than said first outside diameter, and a second cylindrical recess receiving said neck portion, said second cylindrical recess having a diameter that is greater than said second outside diameter, each of said at least two sleeve assembly members further defining a chamfer between said first recess and said second recess, and said inside sleeve having an outside dimension; and an outside sleeve receiving said inside sleeve, said outside sleeve having an outside diameter, and an inside diameter that is the same as said outside diameter of said inside sleeve, and wherein one of said first and second trusses receives said outside sleeve.

9. The connector assembly of claim 8 wherein said at least two sleeve members comprise more than two members.

10. The connector assembly of claim 8 wherein each of said at least two sleeve assembly members comprise a collar portion, said collar portions fitting together to form a collar at an end of said sleeve proximate said neck portion, said collar having an outside dimension that is greater than said outside dimension of said outside sleeve.

11. The connector assembly of claim 8 wherein said connector is a clevis for receiving a matching spade and said clevis defining an aperture there-through for receiving a pin.

12. The connector assembly of claim 8 wherein said connector is a spade for inserting in a matching clevis and said spade defining an aperture there-through for receiving a pin.

13. A connector assembly connecting first truss to a second truss, said connector assembly comprising:

a rotating member comprising a connector, a base portion having a first maximum outside dimension and a neck portion connecting said base portion and said connector, said neck portion having a second maximum outside dimension that is less than said first maximum outside dimension, wherein said connector is a spade for being inserted into a matching clevis and said spade defining an aperture there-through for receiving a pin;

at least two sleeve assembly members that fit together to form an inside sleeve retaining said rotating member, said inside sleeve defining a first recess receiving said base portion that has a minimum dimension that is greater than said first maximum outside dimension, and a second recess receiving said neck portion having a minimum dimension that is greater than said second maximum outside dimension, and said inside sleeve having an outside dimension; and an outside sleeve receiving said inside sleeve, said outside sleeve having an outside dimension and an inside dimension that is the same as said outside dimension of said inside sleeve, and wherein one of said first and second trusses receives said outside sleeve of said connector assembly.

14. The connector assembly of claim 13 wherein each of said at least two sleeve assembly members comprise a collar portion, said collar portions fitting together to form a collar at an end of said sleeve proximate said neck portion, said collar having an outside dimension that is greater than said outside dimension of said outside sleeve.

* * * * *